US006371044B1

(12) United States Patent
Kim

(10) Patent No.: US 6,371,044 B1
(45) Date of Patent: Apr. 16, 2002

(54) WAX COATING DEVICE FOR A WET TYPE ELECTROPHOTOGRAPHIC COLOR PRINTER

(75) Inventor: Yong-su Kim, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 93 days.

(21) Appl. No.: 09/636,766

(22) Filed: Aug. 14, 2000

(30) Foreign Application Priority Data

Nov. 20, 1999 (KR) ..... 99-51445

(51) Int. Cl.[7] ..... B05C 1/08

(52) U.S. Cl. ..... 118/46; 118/236; 118/249; 118/259; 118/DIG. 1; 101/416.1; 101/419; 101/424.2; 396/606; 399/342

(58) Field of Search ..... 118/46, 236, 249, 118/259, DIG. 1; 427/416, 428; 101/416.1, 419, 424.2; 430/961; 399/342; 396/606

(56) References Cited

U.S. PATENT DOCUMENTS 4,407,867 A * 10/1983 Brück et al. ..... 118/235
5,759,278 A * 6/1998 Tomono et al. ..... 118/249
6,260,509 B1 * 7/2001 Aslam et al. ..... 118/DIG. 1

* cited by examiner

*Primary Examiner*—Laura Edwards
(74) *Attorney, Agent, or Firm*—Robert E. Bushnell, Esq.

(57) ABSTRACT

A wax coating device for a wet type electrophotographic color printer is capable of preventing the coating operation when printed matter is not supposed to be wax-coated. The wax coating device includes: a coating roller rotatably disposed so as to be partially immersed in the wax of a wax tank; a pressing roller disposed so as to be in tight contact with the coating roller for pressing the printed matter passing between the pressing and coating rollers against the coating roller; a pressing roller spacer for permitting the printed matter to pass between the pressing and coating rollers by spacing the pressing roller apart from the coating roller; and a coating prevention section for preventing contact of printed matter with the coating roller when the printed matter passes between the spaced pressing and coating rollers by being selectively advanced between and withdrawn from the pressing and coating rollers in accordance with the operation of the pressing roller spacer. The pressing roller spacer includes a pressing roller bracket and a cam gear for alternately rotating the coating prevention section. The coating prevention section includes a cover which is advanced between and withdrawn from the pressing and coating rollers in accordance with the rotational movement of the cam gear. The cover is advanced above the coating roller by the movement of the pressing roller which is spaced from the coating roller. Accordingly, the printed matter which is not supposed to be wax-coated is prevented from making contact with the coating roller.

15 Claims, 6 Drawing Sheets

WAX COATING DEVICE FOR A WET TYPE ELECTROPHOTOGRAPHIC COLOR PRINTER

CLAIM OF PRIORITY

This application makes reference to, incorporates the same herein, and claims all benefits accruing under 35 U.S.C. §119 from my application METHOD AND APPARATUS FOR IMPLEMENTING ANSI TCAP IN MOBILE COMMUNICATION NETWORK SYSTEM filed with the Korean Industrial Property Office on Nov. 20, 1999 and there duly assigned Serial No. 51745/1999.

BACKGROUND OF THE INVENTION

1. Field of the Invention

The present invention relates to a wet type electrophotographic color printer, and more particularly to a wax coating device for a wet type electrophotographic color printer for coating wax on printed matter, thereby protecting images printed on the printed matter.

2. Description of the Prior Art

Generally, a wet type electrophotographic color printer prints a desired image by forming the electrostatic latent image through the processes of: radiating a laser beam onto a photosensitive medium, such as a photosensitive belt; developing the electrostatic latent image formed on the photosensitive medium with a developing solution composed of a solid toner of a certain color and a liquid carrier as a solvent; and transferring the developed form to printed matter.

Generally, in such printers, a liquid condensed ink is used, and that causes newly printed sheets to be sticky. This presents a problem when such sheets are stacked on top of each other. In order to correct the latter problem, a coating of wax is often applied to paper after completion of the printing operation, such wax coating being selectively carried out only for certain type of print media. However, in such printers which carry out the wax coating procedure, there is a further problem in that print media which are not to be coated often can be partially smeared with wax as a result of undesired contact between the print media and a wax coating roller of the printer. There is a need in the prior art for a printer and wax coating device which preclude this undesirable disadvantage.

SUMMARY OF THE INVENTION

The present invention has been developed to overcome the above-mentioned problems of the prior art. Accordingly, it is an object of the present invention to provide a wax coating device for a wet type electrophotographic color printer capable of selectively performing a wax coating operation, i.e., capable of performing a complete wax coating operation on printed matter which requires a wax coating, and capable of preventing the smearing of wax on printed matter which is not supposed to be wax-coated, such as an OHP film, etc. In accordance with the present invention, printed matter is prevented from coming into contact with the coating roller.

The above object is accomplished by a wax coating device for a wet type electrophotographic color printer according to the present invention, which includes: a frame mounted on a printer body; a wax tank fixed on the frame; a coating roller rotatably disposed so as to be partially immersed in wax contained in the wax tank; a pressing roller in tight contact with the coating roller so as to press printed matter passing between the coating roller and the pressing roller against the coating roller; pressing roller spacing means for permitting the printed matter to pass between the pressing and coating rollers without touching the pressing and coating rollers by selectively spacing the pressing roller away from the coating roller; and coating prevention means for preventing the printed matter from making contact with the coating roller by being advanced/withdrawn between/from the pressing and coating rollers in accordance with the movement of the pressing roller spacing means when the printed matter passes between the pressing and coating rollers.

The pressing roller spacing means includes: a pair of pressing roller brackets rotatably disposed on the frame by a pin, each having one end on which the pressing roller is rotatably disposed and another end on which an operational pin is provided; a pair of cam gears rotatably disposed on the frame by means of a shaft, each having cams formed on an outer surface thereof so as to be in contact with the operational pin of the pressing roller brackets, for rotating the pressing roller brackets in such a direction as to enable the pressing roller to be spaced apart from the coating roller; driving means for rotatably driving the cam gears; and a pair of pressing springs disposed between the pressing roller brackets and the wax tank for elastically biasing the pressing roller brackets in such a direction as to enable the pressing roller to be tightly pressed against the coating roller.

The coating prevention means includes: a pair of cam grooves, each formed on an inner surface of a respective cam gear and each having a shape such that a distance from a center of the cam gear to the cam groove progressively increases; a cover disposed for linear movement on a supporting member which is fixed to the frame, the cover having one end on which a pair of operational protrusions is formed so as to be inserted in the cam grooves, the cover covering the coating roller by being advanced/withdrawn between/from the pressing and coating rollers in accordance with the rotational movement of the cam gears; and guiding means for guiding movement of the cover.

In a wax coating device according to the present invention, when there is no need for wax-coating of the printed matter, the pressing roller is spaced from the coating roller while the cover is advanced, thus blocking the coating roller from the pressing roller and the printed matter. Accordingly, when printed matter which is not supposed to be wax-coated passes between the pressing and coating rollers, undesired contact of the printed matter with the coating roller is prevented, and the printed matter is not smeared with wax.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
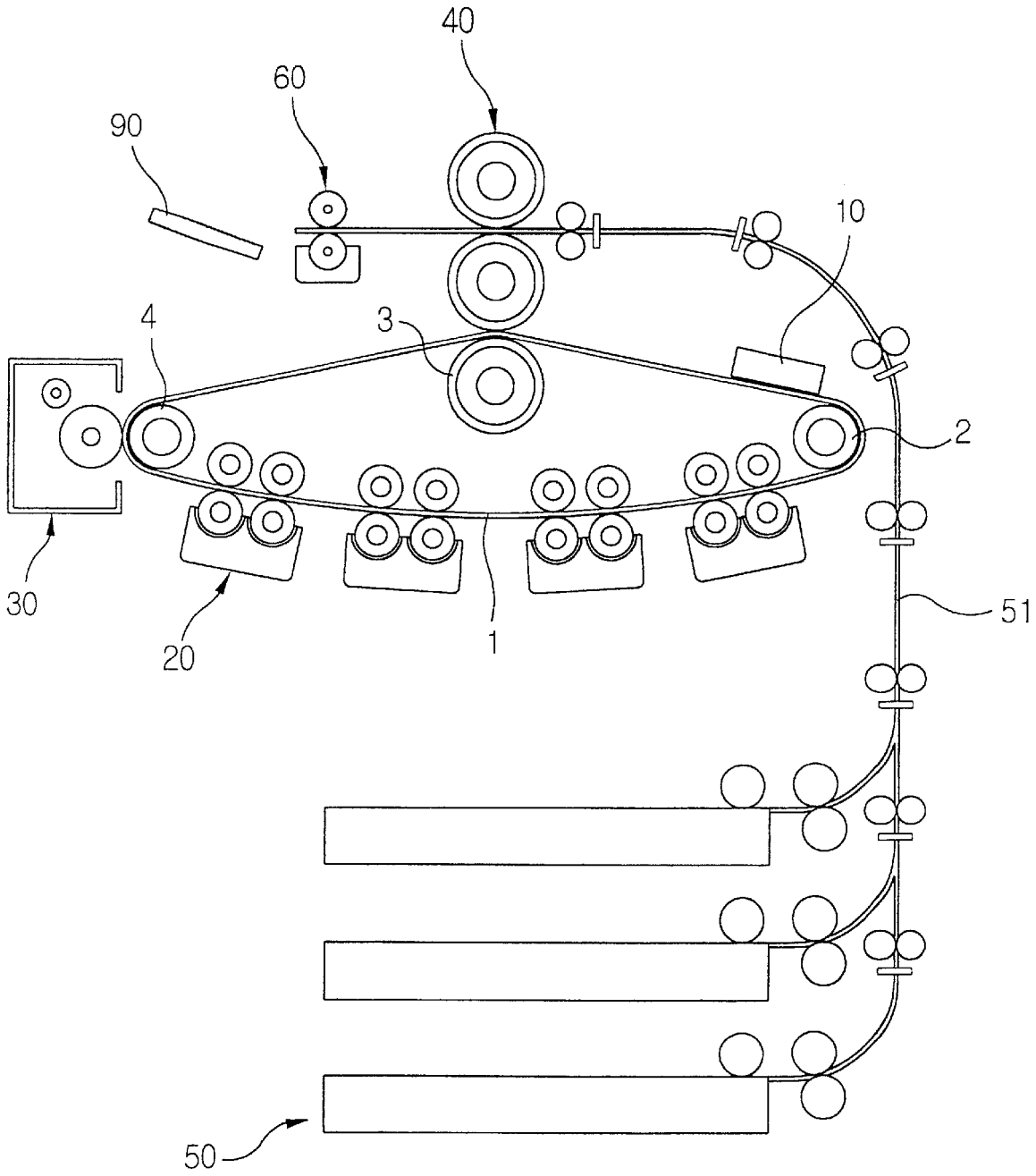
FIG. 1 is a schematic view showing the main portion of a wet type electrophotographic color printer.

Reference will now be made in detail to the present preferred embodiment of the present invention, examples of which are illustrated in the accompanying drawings, wherein like reference numerals refer to the like elements throughout. The embodiment is described. below in order to explain the present invention by referring to the figures.

A wet type electrophotographic color printer is schematically shown in FIG. 1, which will be described briefly below.

As shown in FIG. 1, the printer includes a photosensitive material 1 in the form of a belt reeled to travel on rollers 2, 3, and 4 which are disposed within a printer body (not shown). Around the photosensitive material 1, a charged unit 10, an exposure unit (not shown), a developing unit 20, a drying unit 30, and a transferring/fixing unit 40, etc. are disposed.

An electrostatic latent image is formed on the photosensitive medium so as to be developed by the developing unit 20. The developing unit 20 develops the electrostatic latent image on the surface of the photosensitive medium 1 by jetting developing liquid, and exclusively retaining the toner of the developing liquid at the area of the electrostatic latent image. The drying unit 30 eliminates residue of carrier left from the operation of the developing unit 20 to an extent acceptable for the transferring operation. The transferring/fixing unit 40 transfers the image formed on the photosensitive medium 1 onto the printed matter.

Various print media usable as printed matter are stored in a plurality of cassettes in accordance with their respective sizes and types, and are fed to the transferring/fixing unit 40 along a feeding passage 51. After the image is printed on the printed matter passed through the transferring/fixing unit 40, the printed matter passes through a wax coating device and is stored in a distributing tray 90.

The wax coating device 60 protects the image printed on the printed matter by coating wax over the printed area of the printed matter. More specifically, in the general wet type electrophotographic color printer, a liquid condensed ink is used and the sheets of paper become sticky which is a problem when a plurality of printed sheets are stacked on top of each other. Accordingly, it is necessary to coat wax on the paper after the printing operation. The wax coating operation is selectively performed in accordance with the various kinds of printed matter. If the printed matter is in transparent form, such as an OHP film, etc., the wax coating is not performed, since wax would blur the transparency of the printed matter. Accordingly, the wax coating device has such a construction that it performs a selective wax coating operation in accordance with the kinds of printed matter passing through the printer.

Figure 2:
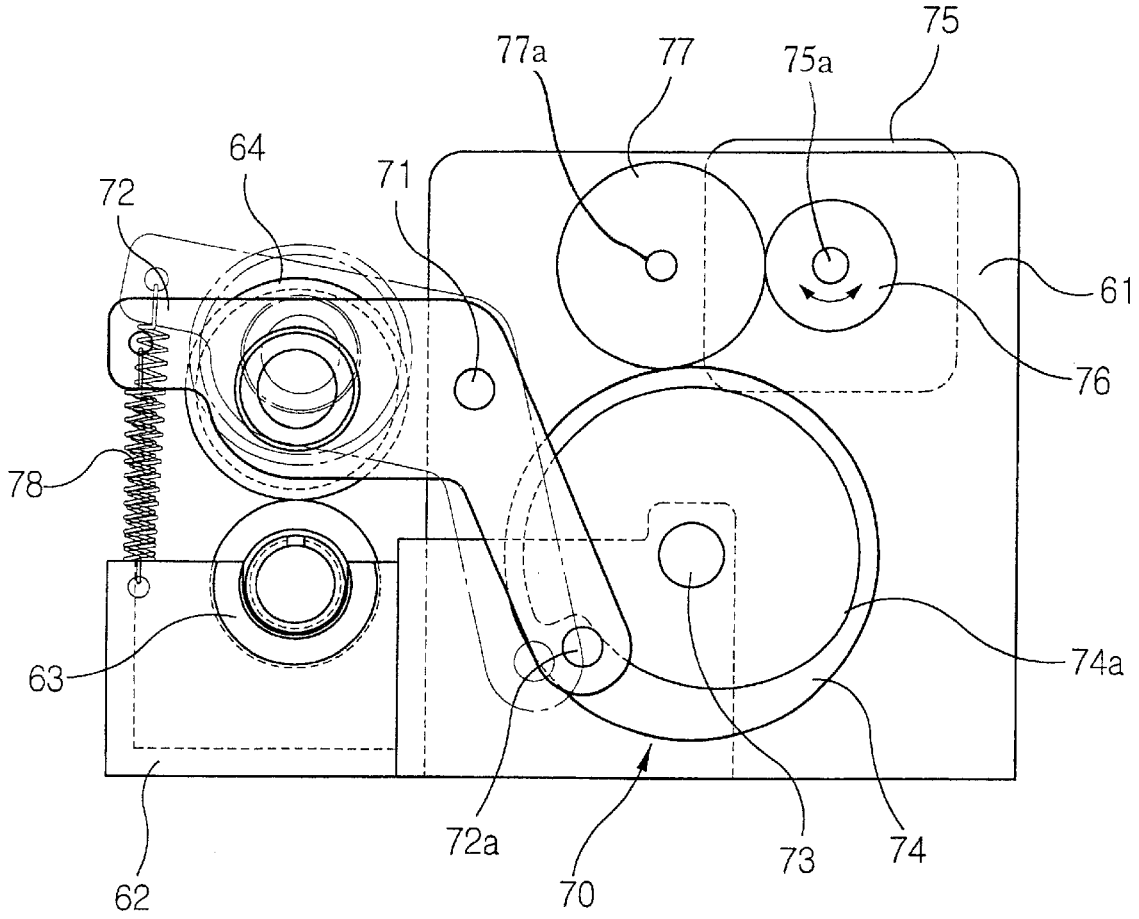
FIG. 2 is a side elevation view showing the structure and operation of a wax coating device of the wet type electrophotographic color printer of FIG. 1.

An example of a wax coating device is schematically shown in FIG. 2. As seen in FIG. 2, the wax coating device includes a frame 61 mounted on a body of a printer, a wax tank 62 fixed on one side of the frame 61 to contain liquid wax, a coating roller 63 rotatably disposed so as to be partially immersed in the wax of the wax tank 62, a pressing roller 64 disposed so as to be in tight contact with the coating roller 63 and to press the printed matter against the coating roller 63, and a pressing roller spacer 70 which permits the printed matter to pass through the coating roller 63 and the pressing roller 64 smoothly by selectively spacing the pressing roller 64 from the coating roller 63.

The pressing roller spacer 70 includes a pair of pressing roller brackets 72 rotatably disposed on the frame 61 by means of a pin 71, a pair of cam gears 74 rotatably disposed on the frame 61 by means of a shaft 73, a driving unit 75 for rotatably driving the cam gears 74, and a pair of pressing springs 78.

The pressing roller 64 is rotatably supported by respective ends of the pressing roller brackets 72, and an operational pin 72*a* protrudes from other respective ends of the pressing roller brackets 72. Furthermore, on the outer surfaces of the cam gears 74, cams 74*a* are formed for making contact with the operational pin 72*a* of the pressing roller brackets 72. Each cam 74*a* is formed so as to have an increasing radius. Accordingly, when the cam gears 74 are rotated, the operational pin 72*a* of the pressing roller brackets 72 is moved along the tracing lines of the cams 74*a,* and the pressing roller brackets 72 are rotated in a direction corresponding to the direction in which the pressing roller 64 is spaced from the coating roller 63.

Further, the driving unit 75 is a motor which is mounted as a driving source on the frame 61, a pinion 76 engaged with a shaft 75*a* of the motor 75, and an idle gear 77 disposed on one side of the frame 61 by means of a shaft 77*a* and engaged with the pinion 76.

The pressing springs 78 are disposed between the pressing roller brackets 72 and the wax tank 62 for elastically biasing, and thus rotating, the pressing roller brackets 72 in such a direction as to enable the pressing roller 64 to be tightly pressed against the coating roller 63. Accordingly, the pressing roller 64 initially makes close contact with the coating roller 63.

In the wax coating device constructed as described above, when the printed matter requires a coating operation, the pressing roller 64 is tightly pressed against the coating roller 63, and presses the printed matter passed between the pressing roller 64 and the coating roller 63, so that wax is coated on the printed matter. That is, as the coating roller 63 is driven, wax from the wax tank 62 is smeared on the coating roller 63 and coats the printed matter passed along the coating roller 63.

When printing on transparent printed matter, such as OHP film, etc. which is not supposed to be wax-coated, the motor 75 is driven so as to rotate the cam gears 74. Accordingly, the pressing roller brackets 72 in contact with the cams 74*a* of the cam gears 74 are rotated against the elastic force of the pressing springs 78, upwardly spacing the pressing roller 64 from the coating roller 63. Since the coating roller 63 and the pressing roller 64 are spaced apart from each other, the transparent printed matter passes therebetween without being smeared with wax from the coating Despite the spacing apart of the pressing roller 64 and the coating roller 63, however, there is a problem of having undesired partial wax smearing on the transparent printed matter when and if the printed matter is drawn downwardly by its weight to make contact with the coating roller 63 disposed below as the printed matter passes between the coating roller 63 and the pressing roller 64. As a result of this undesired smearing of wax on printed matter which is not supposed to be wax-coated, the printing quality of the printed matter deteriorates.

Figure 3:
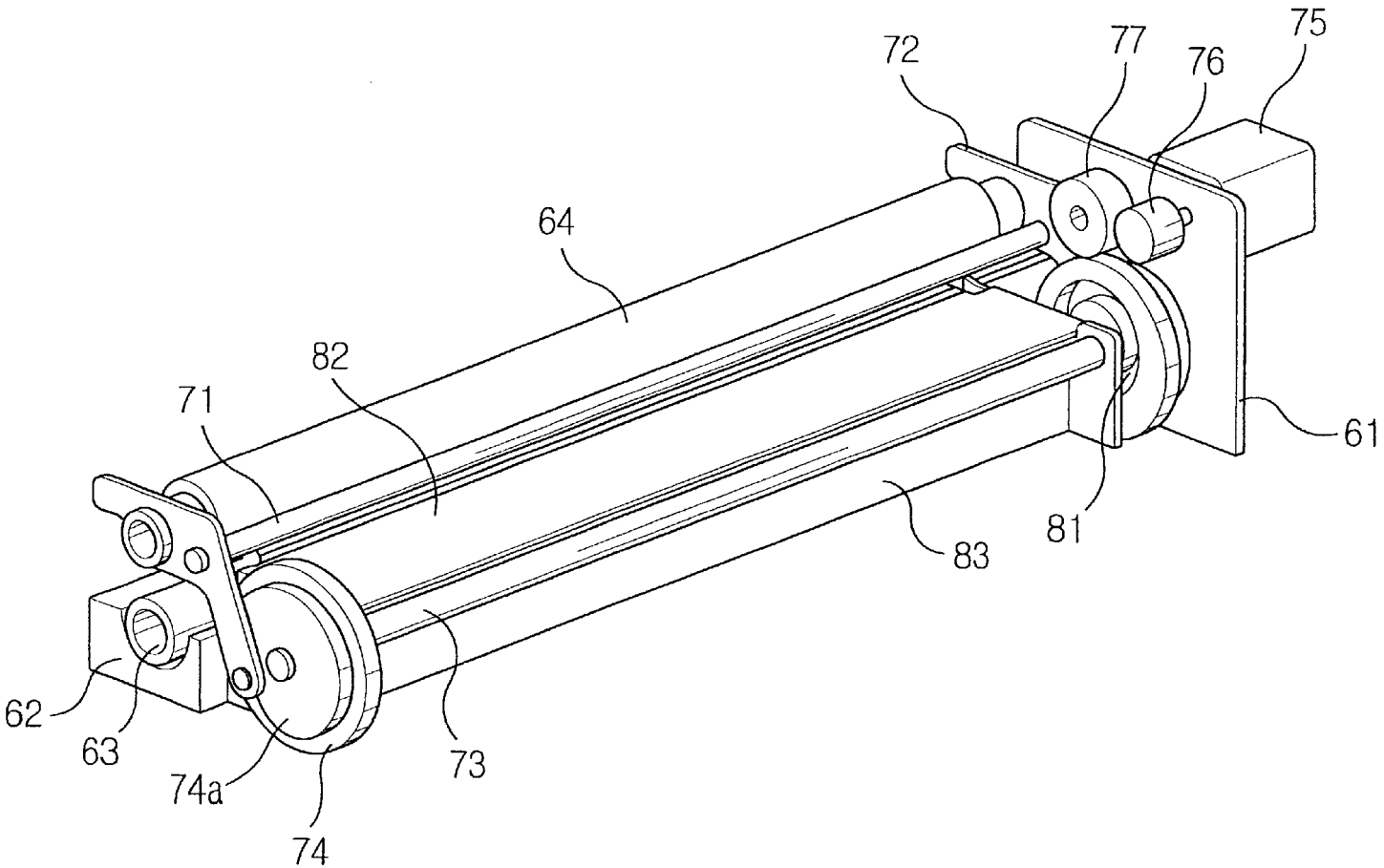
FIG. 3 is a perspective view of a wax coating device for a wet type electrophotographic color printer according to a preferred embodiment of the present invention.
Figure 4:
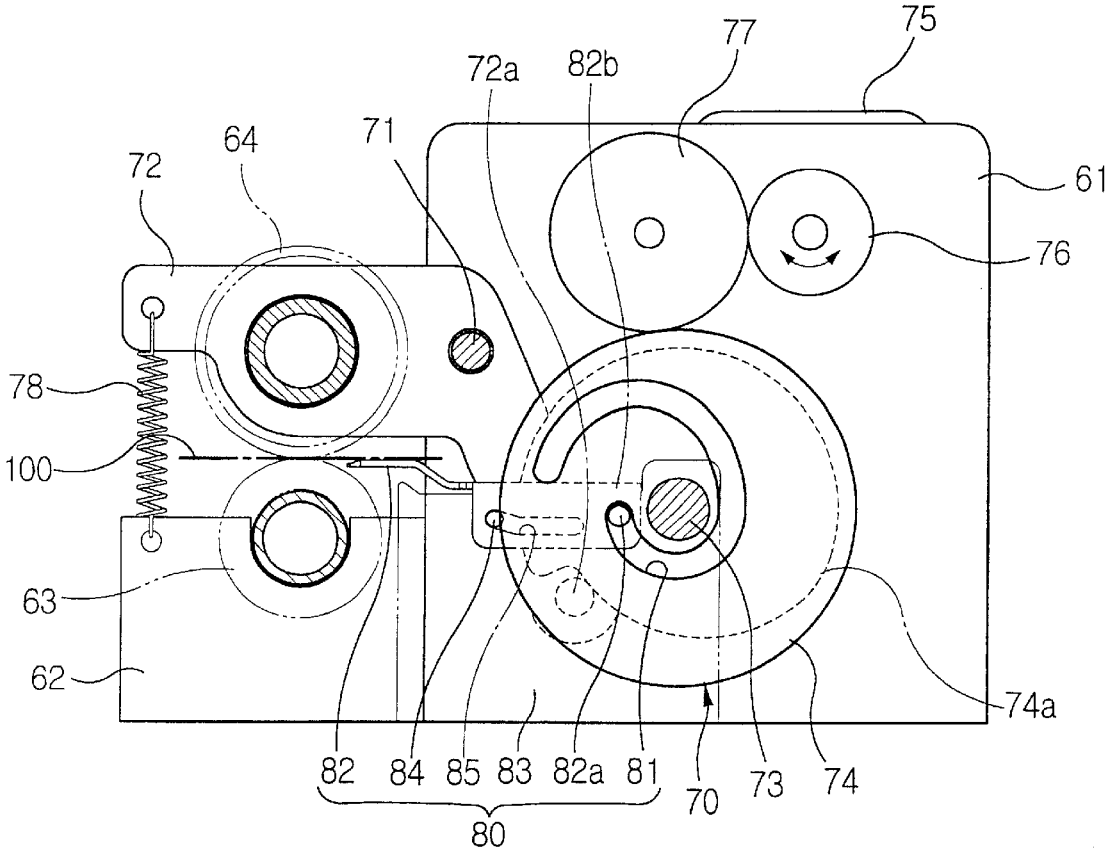
FIG. 4 is a side elevation view showing the wax coating device of FIG. 3 performing the coating operation.

As shown in FIGS. 3 and 4, a wax coating device according to a preferred embodiment of the present invention includes a frame 61 mounted on a body (not shown) of the printer, a wax tank 62 fixed on one side of the frame 61 for containing liquid wax, a coating roller 63 rotatably disposed so as to be partially immersed in the wax of the wax tank 62, a pressing roller 64 disposed in close contact with the coating roller 63 for tightly pressing printed matter which passes between the coating roller 63 and the pressing roller 64 against the coating roller 63, a pressing roller spacer 70 for selectively spacing the pressing roller 64 apart from the coating roller 63 so as to permit the printed matter to pass between the coating roller 63 and pressing roller 64 more smoothly, and coating prevention means 80 for preventing the printed matter from coming into contact with the coating roller 63 by being advanced between the coating roller 63 and pressing roller 64 so as to cover the coating roller 63 when the pressing roller 64 is spaced apart from the coating roller 63.

The pressing roller spacer 70 includes a pair of pressing roller brackets 72 rotatably disposed on the frame 61 by means of a pin 71, a pair of cam gears 74 rotatably disposed on the frame 61 by means of a shaft 73, means for rotatably driving the cam gears 74, and a pair of pressing springs 78.

The pressing roller 64 is rotatably disposed on respective sides of the pressing roller brackets 72, while an operational pin 72*a* protrudes from other respective sides of the pressing roller brackets 72.

Furthermore, cams 74*a* are formed on the outer surface of the cam gears 74 so as to be in contact with the operational pin 72*a* of the pressing roller brackets 72. The cams 74*a* are formed so as to have an increasing radius. Accordingly, when the cam gears 74 are rotated, the operational pin 72*a* of the pressing roller brackets 72 is moved along the tracing lines of the cams 74*a,* rotating the pressing roller brackets 72 in a direction corresponding to the direction in which the pressing roller 64 is spaced apart from the coating roller 63.

Further, the driving means includes a motor 75 as a driving source which is mounted on the frame 61, a pinion 76 engaged with a shaft of the motor 75, and an idle gear 77 disposed on one side of the frame by means of a shaft.

The pressing springs 78 are disposed between the pressing roller brackets 72 and the wax tank 62 so as to elastically bias the pressing roller brackets 72 in such a direction as to enable the pressing roller 64 to be tightly pressed against the coating roller 63. Accordingly, the pressing roller 64 initially makes close contact with the coating roller 63.

The coating prevention means 80 is operated in accordance with the operation of the pressing roller spacer 70, and includes cam grooves 81 formed on the inner surface of respective cam gears 74, a cover 82,having one end inserted in one of the cam grooves 81 so as to be linearly moved by the rotational movement of the cam gears 74, a supporting member 83 for supporting the cover 82, and means for guiding the linear movement of the cover 82.

The cam grooves 81 are formed so that the distance from the center of the cam gears 74 to the cam grooves 81 increases.

On one end of the cover 82, a pair of operational protrusions 82*a* is formed so as to be inserted into the cam grooves 81, while the other end of the cover 82 is to be advanced between the coating roller 63 and pressing roller 64. The cover 82 is substantially in the shape of a rectangle, the longer side of which is the same as the length of the coating roller 63.

The supporting member 83 is fixed to one side of the frame 61.

The cover guiding means includes a guiding protrusion 84 formed on the supporting member 83, and a guiding groove 85 formed on the cover 82 to receive the guiding protrusion 84. More specifically, the guiding groove 85 is formed on an extended portion 82*b,* which extends vertically from the cover 82. Further, the guiding groove 85 is positioned above the coating roller 63 with a certain distance therebetween when the cover 82 is advanced between the coating roller 63 and the pressing roller 64, and guiding groove 85 is positioned at a height corresponding to the position where the coating roller 63 and pressing roller 64 make contact with each other.

In the wax coating device constructed according to the preferred embodiment of the present invention, as described above, when the pressing roller 64 is in tight contact with the coating roller 63, the wax coating operation is performed on the printed matter 100 (FIG. 4) which is passed between the coating roller 63 and pressing roller 64. Then, when the printed matter 100'(FIG. 6), which is not supposed to be wax-coated, such as OHP film, etc., is passed between the coating roller 63 and pressing roller 64, the pressing roller 64 is spaced from the coating roller 63 by the pressing roller spacer 70, so that the wax coating operation is not performed.

Thus, the problem mentioned above (i.e., undesired smearing of partial wax upon the printed matter 100') is completely prevented by the present invention, since the printed matter 100' is not touched by the coating roller 63, even when the printed matter 100' is drawn downward by its weight upon the coating roller 63.

More specifically, when the printed matter 100', which is not supposed to be wax-coated, passes between the coating roller 63 and pressing roller 64, the pressing roller 64 is raised and, simultaneously, the cover 82 is advanced between the coating roller 63 and pressing roller 64, thereby covering the coating roller 63. Such a situation is shown in FIGS. 5 and 6.

Figure 5:
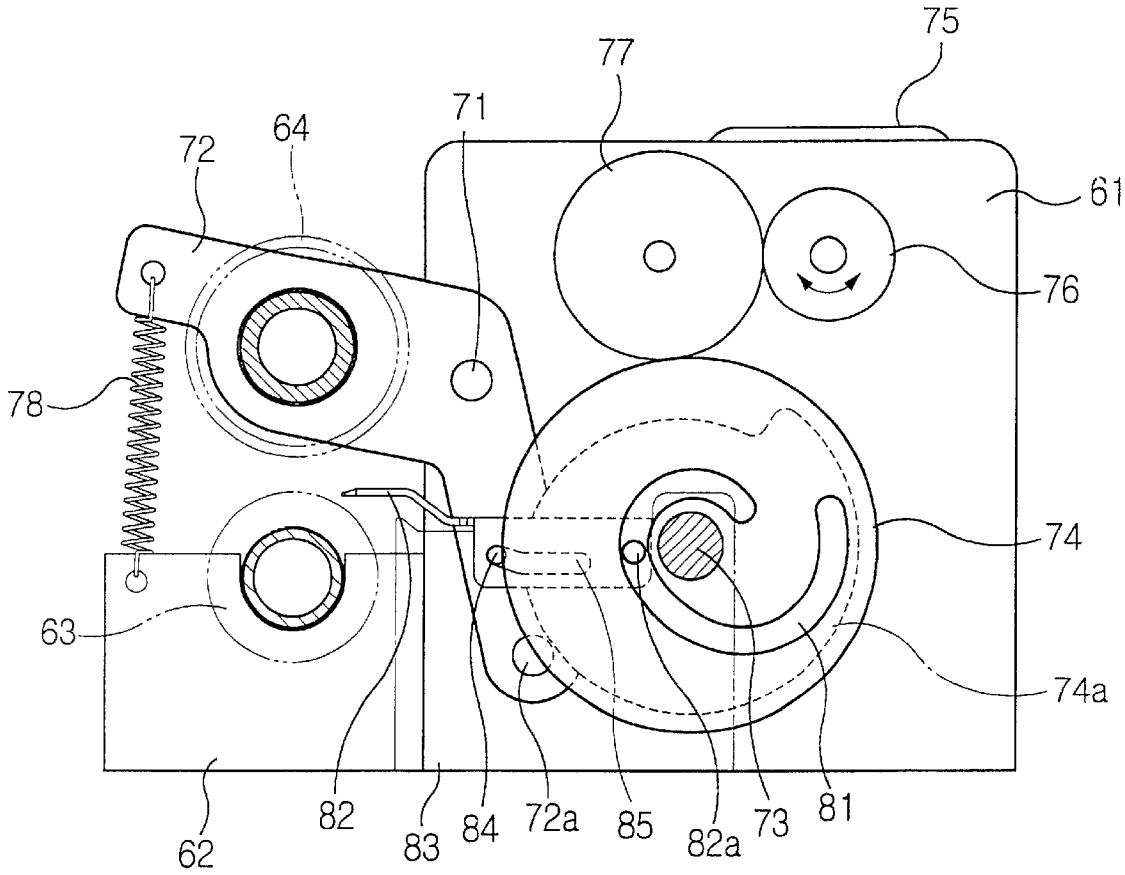
FIG. 5 is a side elevation view showing a coating prevention member being advanced between a coating roller and a pressing roller for preventing wax from being smeared onto the printed matter.
Figure 6:
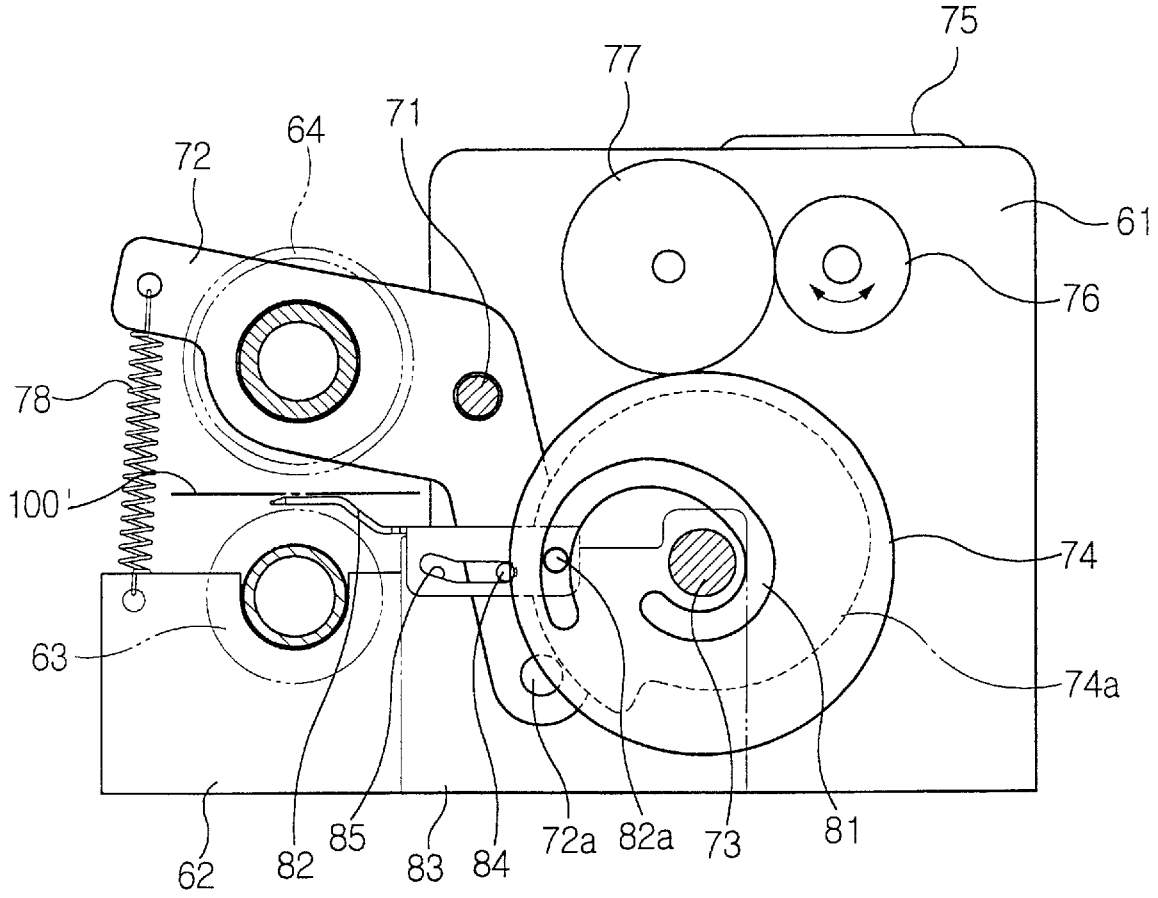
FIG. 6 is a side elevation view showing the coating prevention member between the coating roller and the pressing roller.

FIG. 5 shows the cover 82 being advanced between the coating roller 63 and pressing roller 64 in accordance with the elevation of the pressing roller 64 relative to the coating roller 63, and FIG. 6 shows the cover 82 between the coating roller 63 and pressing roller 64.

Initially, as shown in FIG. 4, the cover 82 is completely withdrawn away from the coating roller 63 and pressing roller 64, which are in tight contact with each other. In such a situation, when the motor 75 is driven, the cam gears 74 are rotated. Since the operational protrusion 82*a* of the cover 82 is inserted into the cam groove 81 formed on the inner surface of the cam gear 74, the cover 82 is advanced leftward in FIG. 5 as the cam gears 74 are rotated.

The cover 82 is advanced until the operational protrusion 82*a* thereof reaches one end of the cam groove 81. When the operational protrusion 82*a* reaches one end of the cam groove 81, the advancement of the cover 82 is stopped. Accordingly, as shown in FIG. 6, the pressing roller 64 is spaced away from the coating roller 63, and the cover 82 is placed above the coating roller 63. Accordingly, the printed matter 100', which passes between the coating roller 63 and pressing roller 64, is prevented from making contact with the coating roller 63 until the printed matter 100' is placed on a distributing tray 90. As a result, the partial smearing of wax upon the printed matter 100', which might have been caused due to the downward drooping of the printed matter 100' by its weight, is prevented.

When the motor 75 is rotated reversely, the pressing roller spacer 70 and the coating preventing means 80 are operated reversely, so that the coating roller 63 and pressing roller 64 return to tight contact with each other, while the cover 82 is withdrawn away from the coating roller 63 and pressing roller 64. Accordingly, the printed matter 100 passing between the coating roller 63 and pressing roller 64 is completely wax-coated.

As described above, according to the present invention, when there is no need to wax-coat the printed matter, the coating roller is covered by the cover, so that the undesired partial-smearing of wax upon the printed matter due to the contact of printed matter with the coating roller is prevented, even when the printed matter is drawn downward by its weight. Accordingly, the printing quality deterioration caused due to the partial smearing of wax, is prevented.

Is As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A wax coating device for a wet electrophotographic color printer, comprising:

a frame mounted on a printer body;

a wax tank fixed on the frame for holding wax;

a coating roller rotatably disposed so as to be partially immersed in the wax held in the wax tank;

a pressing roller which is movable into contact with the coating roller for pressing printed matter passing between the coating roller and the pressing roller against the coating roller;

pressing roller spacing means for selectively spacing the pressing roller away from the coating roller so as to permit the printed matter to pass between the pressing and coating rollers untouched by the pressing and coating rollers; and coating prevention means for preventing the printed matter from making contact with the coating roller by being selectively advanced and withdrawn between and from, respectively, the pressing and coating rollers in accordance with the movement of the pressing roller spacing means when the printed matter passes between the pressing and coating rollers.

2. The wax coating device as claimed in claim 1, wherein the pressing roller spacing means comprises:

a pair of pressing roller brackets rotatably disposed on the frame by an operational pin, each of said brackets having one end on which the pressing roller is rotatably disposed and another end on which an operational pin is provided;

a pair of cam gears rotatably disposed on the frame, each having cams formed on an outer surface thereof so as to be in contact with a respective one of the operational pins of the pressing roller brackets for rotating the pressing roller brackets in a direction to enable the pressing roller to be spaced apart from the: coating roller;

a driving unit for rotatably driving the cam gears; and a pair of pressing springs disposed between the pressing roller brackets and the wax tank for elastically biasing the pressing roller brackets in a direction to enable the pressing roller to be tightly pressed against the coating roller.

3. The wax coating device as claimed in claim 2, wherein the driving unit comprises a motor mounted on the frame and having a shaft, a pinion engaged with the shaft of the motor, and an idle gear disposed on one side of the frame to connect the pinion with the cam gears.

4. The wax coating device as claimed in claim 2, wherein the coating prevention means comprises:

a pair of cam grooves, each formed on an inner surface of the respective cam gears, each having a shape such that a distance from a center of the cam gear to the cam groove increases along a side of the cam groove;

a cover disposed for linear movement and fixed to the frame, the cover having one end on which a pair of operational protrusions is formed to be inserted in the cam grooves, said cover covering the coating roller by being selectively advanced between and withdrawn from the pressing and coating rollers in accordance with rotational movement of the cam gears; and a guiding unit for guiding movement of the cover.

5. The wax coating device as claimed in claim 4, wherein the guiding unit comprises a guiding protrusion protruding from a supporting member of the frame, and a guiding groove formed on the cover to receive the guiding protrusion.

6. The wax coating device as claimed in claim 5, wherein the guiding groove is formed so that, when the cover is advanced between the pressing and coating rollers, the guiding groove is placed above the coating roller, while, when the cover is withdrawn from the pressing and coating rollers, the guiding groove is placed at the same height as a position where the pressing and coating rollers are in contact with each other.

7. The wax coating device as claimed in claim 4, wherein the cover has a longer side which has a length equal to a length of the coating roller.

8. A wax coating device for a wet electrophotographic color printer, comprising:

a frame mounted on a printer body;

a wax tank fixed on the frame for holding wax;

a coating roller rotatably disposed so as to be partially immersed in the wax held in the wax tank;

a pressing roller which is movable into contact with the coating roller for pressing printed matter which is to be coated therebetween, said pressing roller being maintained spaced apart from said coating roller so as to permit printed matter which is not to be coated to pass freely therebetween; and coating prevention means for preventing the printed matter which is not to be coated from making contact with the coating roller by being advanced between the coating roller and the pressing roller when the printed matter which is not to be coated passes freely between the coating and pressing rollers.

9. The wax coating device as claimed in claim 8, further comprising pressing roller spacing means for spacing apart said pressing roller and said coating roller when the printed matter which is not to be coated passes therebetween.

10. The wax coating device as claimed in claim 9, wherein the pressing roller spacing means comprises:

a pair of pressing roller brackets rotatably disposed on the frame by an operational pin, each of said brackets having one end on which the pressing roller is rotatably disposed and another end on which an operational pin is provided;

a pair of cam gears rotatably disposed on the frame, each having cams formed on an outer surface thereof so as to be in contact with a respective one of the operational pins of the pressing roller brackets for rotating the pressing roller brackets in a direction to enable the pressing roller to be spaced apart from the coating roller;

a driving unit for rotatably driving the cam gears; and a pair of pressing springs disposed between the pressing roller brackets and the wax tank for elastically biasing the pressing roller brackets in a direction to enable the pressing roller to be tightly pressed against the coating roller.

11. The wax coating device as claimed in claim 10, wherein the driving unit comprises a motor mounted on the frame and having a shaft, a pinion engaged with the shaft of the motor, and an idle gear disposed on one side of the frame to connect the pinion with the cam gears.

12. The wax coating device as claimed in claim 10, wherein the coating prevention means comprises:

a pair of cam grooves, each formed on an inner surface of the respective cam gears, each having a shape such that a distance from a center of the cam gear to the cam groove increases along a side of the cam groove;

a cover disposed for linear movement on a supporting member fixed to the frame, the cover having one end on which a pair of operational protrusions are formed to be inserted in the cam grooves, said cover covering the coating roller by being selectively advanced between and withdrawn from the pressing and coating rollers in accordance with rotational movement of the cam gears; and a guiding unit for guiding movement of the cover.

13. The wax coating device as claimed in claim 12, wherein the guiding unit comprises a guiding protrusion protruding from the supporting member, and a guiding groove formed on the cover to receive the guiding protrusion.

14. The wax coating device as claimed in claim 13, wherein the guiding groove is formed so that, when the cover is advanced between the pressing and coating rollers, the guiding groove is placed above the coating roller, while, when the cover is withdrawn from the pressing and coating rollers, the guiding groove is placed at a height corresponding to a position where the pressing and coating rollers are in contact with each other.

15. The wax coating device as claimed in claim 12, wherein the cover has a longer side which has a length equal to a length of the coating roller.

* * * * *

UNITED STATES PATENT AND TRADEMARK OFFICE

CERTIFICATE OF CORRECTION

PATENT NO. : 6,371,044 B1
DATED : April 16, 2002
INVENTOR(S) : Yong-Su Kim

It is certified that error appears in the above-identified patent and that said Letters Patent is hereby corrected as shown below:

Title page,
Item [30], Foreign Application Priority Data, correct Korean priority Number from "99-51445" to -- 99-51745 --;

Signed and Sealed this

Seventeenth Day of September, 2002

*Attest:*

*Attesting Officer*

JAMES E. ROGAN
*Director of the United States Patent and Trademark Office*